US005208210A

United States Patent [19]

Sens et al.

[11] Patent Number: 5,208,210

[45] Date of Patent: May 4, 1993

[54] THERMAL TRANSFER PRINTING

[75] Inventors: Ruediger Sens, Mannheim; Karl-Heinz Etzbach, Frankenthal, both of Fed. Rep. of Germany

[73] Assignee: BASF Aktiengesellschaft, Ludwigshafen, Fed. Rep. of Germany

[21] Appl. No.: 763,638

[22] Filed: Sep. 23, 1991

[30] Foreign Application Priority Data

Oct. 9, 1990 [DE] Fed. Rep. of Germany ..... 4031984

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS 4,194,878 3/1980 Birke et al. ..... 8/39 B

FOREIGN PATENT DOCUMENTS 0172591 9/1985 Japan ..... 503/227

3249693 10/1988 Japan ..... 503/227

OTHER PUBLICATIONS

Patent Abstracts of Japan vol. 14, No. 13 (M-918) (3956) Jan. 11, 1990 & JP-A-1 258 996 (Mitsui Toatsu Chem Inc) Oct. 16, 1989.

Patent Abstracts of Japan, vol. 11, No. 120 (M-580) (2567) Apr. 15, 1987 & JP-A-61 262 190 (Sumitomo Chem Co Ltd) Nov. 20, 1986.

Japan Abstract, JP-028188, Feb. 17, 1984, & JP-A-17-2-591, Sep. 6, 1985.

*Primary Examiner*—B. Hamilton Hess

*Attorney, Agent, or Firm*—Oblon, Spivak, McClelland, Maier & Neustadt

[57] ABSTRACT

Anthraquinone dyes I useful for thermal transfer printing have the formula

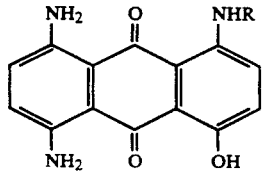

I where R is alkyl, alkoxyalkyl, aryloxyalkyl, alkanoyloxyalkyl, alkoxycarbonyloxyalkyl or alkoxycarbonylalkyl, which may each contain up to 20 carbon atoms and whose carbon chains may be interrupted by form one to four oxygen atoms in ether function, or is $C_5$-$C_8$-cycloalkyl or phenyl which may each be substituted by $C_1$-$C_4$-alkyl or $C_1$-$C_4$-alkoxy.

3 Claims, No Drawings

THERMAL TRANSFER PRINTING

The present invention relates to the use of anthraquinone dyes of the formula I

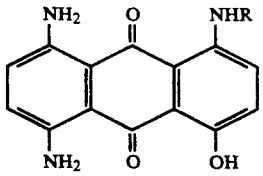

I where R is alkyl, alkoxyalkyl, aryloxyalkyl, alkanoyloxyalkyl, alkoxycarbonyloxyalkyl or alkoxycarbonylalkyl, which may each contain up to 20 carbon atom sand whose carbon chains may be interrupted by from one to four oxygen atom sin ether function, or is $C_5$–$C_8$-cycloalkyl or phenyl which may beach by substituted by $C_1$–$c_4$-alkyl or $C_1$–$C_4$-alkoxy, for thermal transfer printing and specifically to a process for transferring these anthraquinone dyes from a transfer to a plastic-coated medium by diffusion with the aid of a thermal printing head.

The technique of thermal transfer printing is common knowledge; possible heat sources besides lasers and IR lamps are in particular thermal printing heads which are capable of emitting short heating pulses lasting fractions of a second.

In this preferred form of thermal transfer printing, a transfer sheet which contains the dye to be transferred together with one or more binders, a substrate material and possible further assistants such as release agents or crystallization inhibitors is heated by the thermal printing head from the back. This causes the dye to migrate out of the transfer sheet and diffuse into the surface coating of the receiving medium, for example into the plastics coating of a sheet of coated paper.

The essential advantage of this process is that the amount of dye transferred, and hence the color gradation, can be controlled via the energy to be supplied to the thermal printing head.

Thermal transfer printing generally involves the use of the three subtractive primaries yellow, magenta and cyan with or without black, to which the dyes used must have the following properties for optimal color recording: ready thermal transferability, low tendency to migrate within or out of the surface coating of the recording medium at room temperature, high thermal and photo-chemical stability and resistance to moisture and chemicals, no tendency to crystallize out on storage of the transfer sheet, a suitable hue for subtractive color mixing, a high molar absorption coefficient, and ready industrial accessibility.

These requirements are very difficult to meet at one and the same time. For this reason most of the cyan dyes used for thermal transfer printing do not have the required property profile. This is also true of the 1,4,5,8-tetrasubstituted anthraquinones disclosed in and recommended for thermal transfer printing by JP-A-172 591/1985, JP-A-255 897/1986 and EP-A-351 968, which differ from the compounds of the formula I in the nature of the substituents.

It is an object of the present invention to provide cyan dyes suitable for thermal transfer printing which come closer to the require property profile than the prior art dyes.

We have found that this object is achieved by the anthraquinone dyes I defined at the beginning.

The present invention accordingly provides a process for transferring anthraquinone dyes from a transfer to a plastic-coated medium by diffusion with the aid of a thermal printing head, which comprises using for this purpose a transfer on which there is or are one or more anthraquinone dyes I.

In a preferred embodiment of this process, the dyes have the formula I where R is $C_1$–$C_{12}$-alkyl or unsubstituted or $C_1$–$C_4$-alkyl-substituted phenyl.

The anthraquinone dyes I themselves are known per se or obtainable by known methods, for example by the following synthesis scheme:

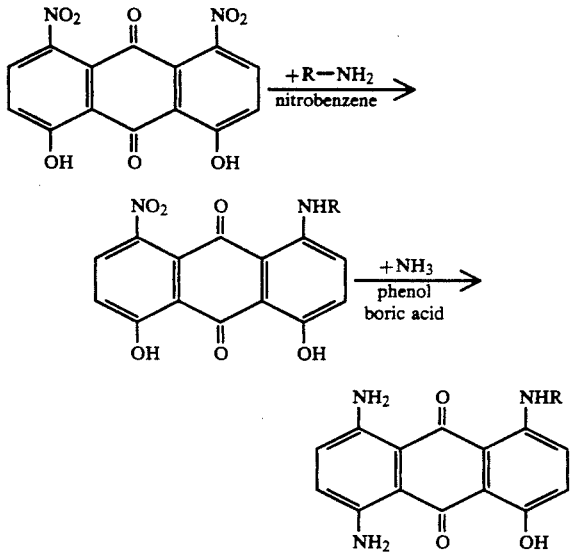

Suitable alkyl R is for example methyl, ethyl, propyl, isopropyl, butyl, isobutyl, sec-butyl, tert-butyl, pentyl, isopentyl, sec-pentyl, tert-pentyl, hexyl, 2-methylpentyl, heptyl, octyl, 2-ethylhexyl, nonyl, decyl, undecyl, dodecyl, tridecyl, tetradecyl, pentadecyl, hexadecyl, heptadecyl, octadecyl, nonadecyl, eicosyl and branched radicals of this kind, alkyl or up to 12 carbon atoms being preferred and alkyl of up to 6 carbon atoms being particularly preferred.

Alkoxyalkyl or aryloxyalkyl R is for example (Ph=phenyl): $—(CH_2)_2—O—CH_3$, $—(CH_2)_2—O—C_2H_5$, $—CH_2)_2—O—C_3H_7$, $—(CH_2)_2—O—C_4H_9$, $—(CH_2)_3—O—CH_3$, $—(CH_2)_3—O—C_2H_5$, $—(CH_2)_3—O—C_3H_7$, $—(CH_2)_3—O—C_4H_9$, $—CH_2—CH(CH_3)—O—CH_3$, $—CH_2—CH(CH_3)—O—C_2H_5$, $—CH_2—CH(CH_3)—O—C_3H_7$, $—CH_2—CH(CH_3)—O—C_4H_9$, $—(CH_2)_4—O—CH_3$, $—(CH_2)_4—O—C_2H_5$, $—(CH_2)_4—O—C_4H_9$, $—(CH_2)_4—O—CH_2—CH(C_2H_5)—C_4H_9$, $—(CH_2)_8—O—CH_3$, $—(CH_2)_8—O—C_4H_9$, $—(CH_2)—O—Ph$, $—(CH_2)_3—O—Ph$ or $—(CH_2)_4—O—Ph$.

It is also possible to use for example the following alkanoyloxyalkyl, alkoxycarbonyloxyalkyl and alkoxycarbonylalkyl groups as R: $—(CH_2)_2—O—CO—CH_3$, $—(CH_2)_2—O—CO—C_4H_9$, $—(CH_2)_2—O—CO—C_6H_{13}$, $—(CH_2)_4—O—CO—C_{12}H_{25}$ or $—(CH_2)_5—O—CO—C_4H_9$; $—(CH_2)_2—O—CO—O—CH_3$, $—(CH_2)_2—O—CO—O—C_4H_9$, $—(CH_2)_2—O—CO—O—C_5H_{11}$, $—(CH_2$-

$)_3—O—CO—O—C_6H_{13}$ or $—(CH_2)_6—O—CO—O—C_2H_5$; $—(CH_2)_2—CO—O—CH_3$, $—(CH_2)_2—CO—O—C_3H_7$, $—(CH_2)_2—CO—O—C_4H_9$ or $—(CH_2)_6—CO—O—CH_2—CH(C_2H_5)—C_4H_9$.

The carbon chains of the abovementioned radicals R may each be interrupted by from one to four oxygen atoms in ether function; examples are: $—[(CH_2)_2—O]_2—CH_3$, $—[(CH_2)_2—O]_2—C_3H_7$, $—[(CH_2)_2—O]_2—C_4H_9$, $—[(CH_2)_4—O]_2—C_2H_5$, $—[(CH_2)_2—CH(CH_3)—O]_2—C_2H_5$, $—[(CH_2)_2—O]_3C_4H_9$, $—[(CH_2)_2—O]_4—CH_3$, $—[(CH_2)_3—O]_4—C_6H_{13}$ and $—[(CH_2)_2—O]_2—(CH_2)_3—O]_2—C_2H_5$; $—[(CH_2)_2—O]_2—Ph$, $—(CH_2)_3—O—(CH_2)_2—O—Ph$, $—[(CH_2)_2—O]_3—Ph$ and $—[(CH_2)_2—O]_3—Ph—3—CH_3$; $—(CH_2)_2—O—CO—(CH_2)_2—O—(CH_2)_2—O—C_4H_9$; $—(CH_2)_4—O—CO—O—(CH_2)_2——C_4H_9$; $—(CH_2)_2—CO—O—(CH_2)_2—O—C_4H_9$, $—(CH_2)_2—CO—O—](CH_2)_2—O]_2—CH_3$ and $—(CH_2)_4—CO—O—(CH_2)_2—O—C_4H_9$.

Further possible meanings of R are cycloalkyl and especially phenyl, which may each be substituted by $C_1$-$C_4$-alkyl or $C_1$-$C_4$-alkoxy, e.g. ($C_5C_9$=cyclopentyl and $C_6H_{11}$=cyclohexyl): $—C_5H_9$, $—C_6H_{11}$, $—C_6—H_{10}—4—CH_3$ and $—C_6—H_{10}—4—O—CH_3$; —Ph, —Ph—2—$CH_3$, —Ph—3—$CH_3$, —Ph—4—$CH_3$, —Ph—2—$C(CH_3)_3$, —Ph—4—$C(CH_3)_3$, —Ph—2—O—$CH_3$, —Ph—3—$CH_2H_5$ and —Ph—4—O—$C_4H_9$.

Compared with the cyan dyes hitherto used for thermal transfer printing, the anthraquinone dyes I to be used according to the present invention have the following properties: ready thermal transferability despite the relatively high molecular weight, improved migration properties in the recording medium at room temperature, higher light fastness, better resistance to moisture and chemicals, better solubility in the preparation of the printing ink, higher color strength, higher cleanness of hue and readier industrial accessibility.

Moreover, the dyes I, alone or combined with other classes of dyes, give neutral, strong black prints.

The transfer sheets required as dye donors for the thermal transfer process of the present invention are prepared as follows. The anthraquinone dyes I are incorporated in an organic solvent e.g. isobutanol, methyl ethyl ketone, methylene chloride, chlorobenzene, toluene, tetrahydrofuran or a mixture thereof, with one or more binders and possibly further assistants such as release agents or crystallization inhibitors to form a printing ink in which the dyes are preferably present in a molecularly dispersed, i.e. dissolved, form. The printing ink is then applied to an inert substrate and dried.

Suitable binders for this purpose are all materials which are soluble in organic solvents and known to be useful for thermal transfer printing, e.g. cellulose derivatives such as methylcellulose, hydroxypropylcellulose, cellulose acetate or cellulose acetobutyrate, in particular ether cellulose, ethylhydroxyethylcellulose and cellulose acetate hydrogen phthalate, starch, alginates, alkyd resins and vinyl resins such as polyvinyl alcohol or polyvinylpyrrolidone and also in particular polyvinyl acetate and polyvinyl butyrate. It is also possible to use polymers and copolymers of acrylates or their derivatives, such as polyacrylic acid, polymethyl methacrylate or styrene-acrylate copolymers, polyester resins, polyamide resins, polyurethane resins or natural resins such as gum arabic.

The binders mentioned hold the dye, after the printing ink has dried, in the form of a transparent film in which no visible crystallization of the dye occurs.

Preferred binders are ethylcellulose or ethylhydroxyethylcellulose in medium to low viscosity formulations. Frequently it is also advisable to use binder mixtures, for example those of ethylcellulose and polyvinyl butyrate in a weight ratio of 2:1.

The weight ratio of binder to dye ranges in general from 8:1 to 1:1, preferably form 5:1 to 2:1.

The assistants used are for example release agents based on perfluorinated alkylsulfonamidoalkyl esters or silicones as described in EP-A-227 092 and EP-A-192 435, and in particular organic additives which prevent the transfer dyes from crystallizing out in the course of storage and heating of the inked ribbon, for example cholesterol or vanillin.

Inert substrate materials are for example tissue, blotting or parchment paper and films made of heat resistant plastics such as polyesters, polyamides or polyimides, which films which may also be metal-coated.

The inert substrate may additionally have on the side facing the thermal printing head a lubricant layer to prevent sticking of the thermal printing head to the substrate material. Suitable lubricants are, for example silicones or polyurethanes as described in EP-A-216 483 and EP-A-227 095.

The thickness of the substrate is in general from 3 to 30 μm, preferably from 5 to 10 μm.

The medium to be printed, e.g., paper, must in turn have a coating of a binder which takes up the dye on printing. The materials used for this purpose are preferably polymeric materials whose glass transition temperatures $T_g$ are within the range from 50 to 100° C., e.g. polycarbonates and polyesters. Further details may be found in EP-A-227 094, EP-A-133 012, EP-A-133 011, EP-A-111 004, JP-A-199 997/1986, JP-A-283 595/1986, JP-A-237 694/1986 and JP-A-127 392/1986.

The process of the present invention is carried out using a thermal printing head which is heatable to above 300° C., so that transfer of the dye takes place within a period of not more than 15 msec.

EXAMPLES

First, transfer sheets (donors) were prepared in a conventional manner form 8 μm thick polyester film, coated with an approximately 5 μm thick transfer layer of a binder B which in each case contained 0.5 g of anthraquinone dye I. The weight ratio of binder to dye was in each case 2:1.

The medium to be printed (receptor) was paper of approximately 120 μm thickness which had been coated with an 8 μm thick plastics layer (Hitachi Color Video Print Paper).

Donor and receptor were placed on top of one another with the coated sides next to each other, wrapped in aluminum foil and heated between two hot plates at 70°–80° C. for 2 minutes. This operation was repeated three times on similar samples at ever higher temperatures within the range from 80 to 120° C.

The amount of dye which diffuses into the plastics layer of the receptor on heating is proportional to the optical density which was determined photometrically as absorbance A after each heating to the above-specified temperatures.

The plot of the logarithm of the measured absorbances A against the reciprocal of the corresponding absolute temperature is a straight line from whose slope it is possible to calculate the activation energy $\Delta E_T$ for the transfer experiment:

$$\Delta E_T = 2.3 \times R \times \frac{\Delta \log A}{\Delta\left[\frac{1}{T}\right]} \quad R\text{: general gas constant}$$

From the plot it is additionally possible to discern the temperature T* at which the absorbance attains the value 1 i.e. at which the transmitted light intensity is one tenth of the incident light intensity. The lower the values of the temperature T*, the better the thermal transferability of the investigated dye.

The table which follows lists the anthraquinone dyes I which were tested in respect of their thermal transfer characteristics together with their absorption maxima $\lambda_{max}$ measured in methylene chloride.

The table also shows the particular binder B used. The abbreviations have the following meanings: EC=ethylcellulose, EHEC=ethylhydroxyethylcellulose, PVB=polyvinyl butyrate, MX=EC:PVB=2:1.

Other characteristic data listed are the aforementioned parameters T* and $\Delta E_T$.

TABLE

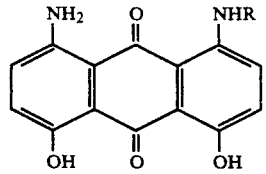

I

| Example | R | $\lambda_{max}$[nm] | B | T* [°C.] | $\Delta E_T$ [kcal/mol] |
|---|---|---|---|---|---|
| 1 | —Ph-4-C(CH3)3 | 657 | EHEC | 92 | 17 |
| | | | MX | 84 | 17 |
| 2 | —Ph-2-CH3 | 659 | EHEC | 80 | 18 |
| 3 | —C6H13 | 660 | EC | 78 | 16 |

We claim:

1. In a process for thermotransfer printing, wherein the improvement comprises using as the transfer dye an anthraquinone dye of the formula I

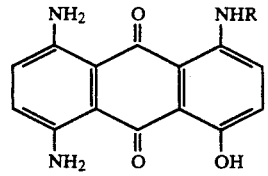

I where R is alkyl, alkoxyalkyl, aryloxyalkyl, alkanoyloxyalkyl, alkoxycarbonyloxyalkyl or alkoxycarbonylalkyl, which may each contain up to 20 carbon atoms and whose carbon chains may be interrupted by from one to four oxygen atoms in ether function, or is $C_5$–$C_8$-cycloalkyl or phenyl which may each be substituted by $C_1$–$C_4$-alkyl or $C_1$–$C_4$-alkoxy.

2. In a process as claimed in claim 1, wherein one or more anthraquinone dyes of the formula I are transferred by diffusion.

3. In a process as claimed in claim 2, wherein R in the formula I of the anthraquinone dye used is $C_1$–$C_{12}$-alkyl, phenyl or $C_1$–$C_4$-alkyl-substituted phenyl.

* * * * *